US010573255B2

(12) United States Patent
Ikeda et al.

(10) Patent No.: US 10,573,255 B2
(45) Date of Patent: Feb. 25, 2020

(54) DISPLAY APPARATUS AND CONTROL METHOD THEREFOR

(71) Applicant: CANON KABUSHIKI KAISHA, Tokyo (JP)

(72) Inventors: Takeshi Ikeda, Ebina (JP); Yasuo Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/983,800

(22) Filed: May 18, 2018

(65) Prior Publication Data

US 2018/0342213 A1 Nov. 29, 2018

(30) Foreign Application Priority Data

May 25, 2017 (JP) ..... 2017-103860

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2310/08* (2013.01); *G09G 2320/0247* (2013.01); *G09G 2320/064* (2013.01); *G09G 2320/0646* (2013.01); *G09G 2320/0686* (2013.01); *G09G 2320/08* (2013.01); *G09G 2320/103* (2013.01); *G09G 2340/16* (2013.01); *G09G 2354/00* (2013.01)

(58) Field of Classification Search
CPC ..... G09G 3/3611; G09G 2320/08; G09G 2320/0686; G09G 2320/064; G09G 2320/0646; G09G 2320/103; G09G 2320/0247; G09G 2340/16; G09G 2354/00; G09G 2310/08; G09G 3/34–3426; G09G 3/36; G09G 2320/066; G09G 2360/16
USPC ..... 345/87, 204, 690
See application file for complete search history.

(56) References Cited

U.S. PATENT DOCUMENTS

2004/0252111 A1* 12/2004 Cheon ..... G09G 3/20 345/204
2014/0232764 A1* 8/2014 Nishio ..... G02F 1/1336 345/690
2014/0368420 A1* 12/2014 Nishio ..... G09G 3/3406 345/102

FOREIGN PATENT DOCUMENTS

JP 2004-287420 A 10/2004
JP 4559099 B2 * 10/2010

OTHER PUBLICATIONS

Translation of JP4559099B2 (Year: 2010).*

* cited by examiner

*Primary Examiner* — Roberto W Flores
(74) *Attorney, Agent, or Firm* — Canon USA, Inc., IP Division

(57) ABSTRACT

A display apparatus sequentially receiving a plurality of frames including first and second frames and displaying an image based on the frames includes a backlight module, a liquid crystal panel, a light emission control unit configured to control light emissions executed by the backlight module with brightnesses based on the frames, and a liquid crystal control unit configured to control transmittance of the liquid crystal panel based on a frame corrected based on the brightnesses of the backlight module. In this case, the light emission control unit starts controlling the light emissions executed by the backlight module with the brightnesses based on the first frame after the liquid crystal control unit starts controlling the transmittance of the liquid crystal panel based on the second frame corrected based on the first frame.

10 Claims, 12 Drawing Sheets

| | 1 | 2 | 3 | 4 | 5 | 6 | 7 | 8 | 9 | 10 |
|---|---|---|---|---|---|---|---|---|---|---|
| 1 | 0 | 0 | 0 | 0 | 0 | 0 | 0 | 0 | 0 | 0 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 6 | 0 | 0 | 0 | 0 | 0 | 0 | 0 | 0 | 0 | 0 |

| | 1 | 2 | 3 | 4 | 5 | 6 | 7 | 8 | 9 | 10 |
|---|---|---|---|---|---|---|---|---|---|---|
| 1 | 512 | 512 | 512 | 512 | 512 | 512 | 512 | 512 | 512 | 512 |
| 2 | 512 | 512 | 512 | 512 | 512 | 512 | 512 | 512 | 512 | 512 |
| 3 | 512 | 512 | 512 | 512 | 800 | 800 | 512 | 512 | 512 | 512 |
| 4 | 512 | 512 | 512 | 512 | 800 | 800 | 512 | 512 | 512 | 512 |
| 5 | 512 | 512 | 512 | 512 | 512 | 512 | 512 | 512 | 512 | 512 |
| 6 | 512 | 512 | 512 | 512 | 512 | 512 | 512 | 512 | 512 | 512 |

FIG. 5A

| | 1 | 2 | 3 | 4 | 5 | 6 | 7 | 8 | 9 | 10 |
|---|---|---|---|---|---|---|---|---|---|---|
| 1 | 0.01 | 0.01 | 0.01 | 0.01 | 0.01 | 0.01 | 0.01 | 0.01 | 0.01 | 0.01 |
| 2 | 0.01 | 0.01 | 0.01 | 0.01 | 0.01 | 0.01 | 0.01 | 0.01 | 0.01 | 0.01 |
| 3 | 0.01 | 0.01 | 0.01 | 0.01 | 0.01 | 0.01 | 0.01 | 0.01 | 0.01 | 0.01 |
| 4 | 0.01 | 0.01 | 0.01 | 0.01 | 0.01 | 0.01 | 0.01 | 0.01 | 0.01 | 0.01 |
| 5 | 0.01 | 0.01 | 0.01 | 0.01 | 0.01 | 0.01 | 0.01 | 0.01 | 0.01 | 0.01 |
| 6 | 0.01 | 0.01 | 0.01 | 0.01 | 0.01 | 0.01 | 0.01 | 0.01 | 0.01 | 0.01 |

FIG. 5B

| | 1 | 2 | 3 | 4 | 5 | 6 | 7 | 8 | 9 | 10 |
|---|---|---|---|---|---|---|---|---|---|---|
| 1 | 50.1 | 50.1 | 50.1 | 50.1 | 50.1 | 50.1 | 50.1 | 50.1 | 50.1 | 50.1 |
| 2 | 50.1 | 50.1 | 50.1 | 50.1 | 50.1 | 50.1 | 50.1 | 50.1 | 50.1 | 50.1 |
| 3 | 50.1 | 50.1 | 50.1 | 50.1 | 78.2 | 78.2 | 50.1 | 50.1 | 50.1 | 50.1 |
| 4 | 50.1 | 50.1 | 50.1 | 50.1 | 78.2 | 78.2 | 50.1 | 50.1 | 50.1 | 50.1 |
| 5 | 50.1 | 50.1 | 50.1 | 50.1 | 50.1 | 50.1 | 50.1 | 50.1 | 50.1 | 50.1 |
| 6 | 50.1 | 50.1 | 50.1 | 50.1 | 50.1 | 50.1 | 50.1 | 50.1 | 50.1 | 50.1 |

FIG. 6A

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 1 | 1 | 1 | 1 | 1 | 1 | 1 | 1 | 1 | 1 |
| 3 | 1 | 1 | 1 | 1 | 1 | 1 | 1 | 1 | 1 | 1 |
| 4 | 1 | 1 | 1 | 1 | 1 | 1 | 1 | 1 | 1 | 1 |
| 5 | 1 | 1 | 1 | 1 | 1 | 1 | 1 | 1 | 1 | 1 |
| 6 | 1 | 1 | 1 | 1 | 1 | 1 | 1 | 1 | 1 | 1 |

FIG. 6B

| | 1 | 2 | 3 | 4 | 5 | 6 | 7 | 8 | 9 | 10 |
|---|---|---|---|---|---|---|---|---|---|---|
| 1 | 5010 | 5010 | 5010 | 5010 | 5010 | 5010 | 5010 | 5010 | 5010 | 5010 |
| 2 | 5010 | 5010 | 5010 | 5010 | 5010 | 5010 | 5010 | 5010 | 5010 | 5010 |
| 3 | 5010 | 5010 | 5010 | 5010 | 7820 | 7820 | 5010 | 5010 | 5010 | 5010 |
| 4 | 5010 | 5010 | 5010 | 5010 | 7820 | 7820 | 5010 | 5010 | 5010 | 5010 |
| 5 | 5010 | 5010 | 5010 | 5010 | 5010 | 5010 | 5010 | 5010 | 5010 | 5010 |
| 6 | 5010 | 5010 | 5010 | 5010 | 5010 | 5010 | 5010 | 5010 | 5010 | 5010 |

| | 1 | 2 | 3 | 4 | 5 | 6 | 7 | 8 | 9 | 10 |
|---|---|---|---|---|---|---|---|---|---|---|
| 1 | 1.04 | 1.00 | 1.04 | 1.02 | 1.04 | 1.01 | 1.02 | 1.01 | 1.02 | 1.04 |
| 2 | 1.03 | 1.00 | 1.03 | 1.04 | 0.99 | 1.01 | 1.02 | 1.05 | 1.10 | 0.98 |
| 3 | 1.00 | 1.01 | 1.05 | 1.05 | 0.99 | 1.00 | 1.00 | 1.00 | 1.02 | 0.95 |
| 4 | 1.03 | 1.02 | 1.00 | 0.96 | 1.00 | 1.00 | 1.00 | 1.01 | 0.95 | 1.00 |
| 5 | 0.99 | 1.06 | 1.02 | 1.01 | 1.00 | 0.96 | 1.00 | 0.99 | 0.96 | 1.03 |
| 6 | 0.99 | 1.02 | 1.04 | 1.04 | 1.10 | 1.00 | 1.05 | 1.00 | 1.01 | 1.00 |

FIG. 9A

| | 1 | 2 | 3 | 4 | 5 | 6 | 7 | 8 | 9 | 10 |
|---|---|---|---|---|---|---|---|---|---|---|
| 1 | 0.002 | 0.002 | 0.002 | 0.002 | 0.002 | 0.002 | 0.002 | 0.002 | 0.002 | 0.002 |
| 2 | 0.002 | 0.002 | 0.002 | 0.002 | 0.002 | 0.002 | 0.002 | 0.002 | 0.001 | 0.002 |
| 3 | 0.002 | 0.002 | 0.002 | 0.002 | 0.002 | 0.002 | 0.002 | 0.002 | 0.002 | 0.002 |
| 4 | 0.001 | 0.002 | 0.002 | 0.002 | 0.002 | 0.002 | 0.002 | 0.002 | 0.002 | 0.002 |
| 5 | 0.002 | 0.002 | 0.002 | 0.002 | 0.002 | 0.002 | 0.002 | 0.002 | 0.002 | 0.002 |
| 6 | 0.002 | 0.002 | 0.002 | 0.002 | 0.002 | 0.002 | 0.002 | 0.002 | 0.002 | 0.002 |

FIG. 9B

| | 1 | 2 | 3 | 4 | 5 | 6 | 7 | 8 | 9 | 10 |
|---|---|---|---|---|---|---|---|---|---|---|
| 1 | 7.708 | 8.016 | 2505 | 7.859 | 7.708 | 7.937 | 7.859 | 7.937 | 7.859 | 7.708 |
| 2 | 7.783 | 8.016 | 7.783 | 7.708 | 8.097 | 7.937 | 7.859 | 7.634 | 7.287 | 12.767 |
| 3 | 8.016 | 7.937 | 7.634 | 7.634 | 8.097 | 12.512 | 8.016 | 8.016 | 7.859 | 13.171 |
| 4 | 7.783 | 7.859 | 8.016 | 2505 | 12.512 | 12.512 | 8.016 | 7.937 | 13.171 | 8.016 |
| 5 | 8.097 | 2505 | 7.859 | 7.937 | 8.016 | 8.35 | 8.016 | 8.097 | 13.033 | 7.783 |
| 6 | 8.097 | 7.859 | 7.708 | 7.708 | 7.287 | 8.016 | 7.634 | 8.016 | 7.937 | 8.016 |

FIG. 10A

| | 1 | 2 | 3 | 4 | 5 | 6 | 7 | 8 | 9 | 10 |
|---|---|---|---|---|---|---|---|---|---|---|
| 1 | 10000 | 10000 | 10000 | 10000 | 10000 | 10000 | 10000 | 10000 | 10000 | 10000 |
| 2 | 10000 | 10000 | 10000 | 10000 | 10000 | 10000 | 10000 | 10000 | 10000 | 10000 |
| 3 | 10000 | 10000 | 10000 | 10000 | 10000 | 10000 | 10000 | 10000 | 10000 | 10000 |
| 4 | 10000 | 10000 | 10000 | 10000 | 10000 | 10000 | 10000 | 10000 | 10000 | 10000 |
| 5 | 10000 | 10000 | 10000 | 10000 | 10000 | 10000 | 10000 | 10000 | 10000 | 10000 |
| 6 | 10000 | 10000 | 10000 | 10000 | 10000 | 10000 | 10000 | 10000 | 10000 | 10000 |

FIG. 10B

| | 1 | 2 | 3 | 4 | 5 | 6 | 7 | 8 | 9 | 10 |
|---|---|---|---|---|---|---|---|---|---|---|
| 1 | 2.00 | 2.00 | 2.00 | 2.00 | 1.80 | 1.80 | 2.00 | 2.00 | 2.00 | 2.00 |
| 2 | 2.00 | 2.00 | 2.00 | 1.80 | 1.50 | 1.50 | 1.80 | 2.00 | 2.00 | 2.00 |
| 3 | 2.00 | 2.00 | 1.80 | 1.50 | 0.90 | 0.90 | 1.50 | 1.80 | 2.00 | 2.00 |
| 4 | 2.00 | 2.00 | 1.80 | 1.50 | 0.90 | 0.90 | 1.50 | 1.80 | 2.00 | 2.00 |
| 5 | 2.00 | 2.00 | 2.00 | 1.80 | 1.50 | 1.50 | 1.80 | 2.00 | 2.00 | 2.00 |
| 6 | 2.00 | 2.00 | 2.00 | 2.00 | 1.80 | 1.80 | 2.0 | 2.00 | 2.00 | 2.00 |

DISPLAY APPARATUS AND CONTROL METHOD THEREFOR

BACKGROUND

Field of the Disclosure

The present disclosure generally relates to display technology and, more particularly, to a display apparatus including a backlight and a transmissive display panel and a control method therefor.

Description of the Related Art

Presently, a display apparatus has been demanded which can display a high contrast image with a wider dynamic range than before for use in movie shooting and broadcasting fields. In a display apparatus including a backlight having a plurality of light sources and a liquid crystal panel displaying an image by transmitting light from the backlight, local dimming control is performed for display of a high contrast image by individually controlling light emissions from the light sources. A display apparatus under local dimming control can lower the brightnesses of the light sources corresponding to regions of the liquid crystal panel for displaying a dark image to reduce an influence of leakage of light so that a dark image can be displayed much darker than that displayed by a conventional display apparatus.

Performing the local dimming control on the backlight can correct an image signal in accordance with an irradiated light distribution from the backlight to reduce changes of an image to be displayed due to changes of the irradiated light distribution under local dimming control.

Japanese Patent Laid-Open No. 2004-287420 discloses a display apparatus which changes the brightness of a backlight when data transfer to a liquid crystal driver configured to drive a liquid crystal panel completes and the transmittance of the liquid crystal starts changing so that image quality degradation can be prevented.

SUMMARY

A display apparatus according to one or more aspects of the present disclosure sequentially receives a plurality of frames including a first frame and a second frame and displays an image based on the frames. The display apparatus includes a backlight including a plurality of light emission regions executing light emissions, the light emissions being individually controllable, a liquid crystal panel having a plurality of liquid crystal pixels and configured to display an image by transmitting light from the backlight, a light emission control unit configured to control the light emissions executed by the light emission regions with brightnesses based on regions of the frames corresponding to the light emission regions, and a display control unit configured to control transmittance of the liquid crystal panel based on a frame corrected based on the brightnesses of the light emission regions. In this case, the light emission control unit starts controlling the light emissions executed by the light emission regions with the brightnesses of the light emission regions based on the first frame after the display control unit starts controlling the transmittance of the liquid crystal panel based on the second frame corrected according to the brightnesses of the light emission regions based the first frame.

Further features of the present disclosure will become apparent from the following description of exemplary embodiments with reference to the attached drawings.

BRIEF DESCRIPTION OF THE DRAWINGS

FIGS. 5A and 5B are schematic diagrams illustrating target brightness of light emission regions determined based on an image.

FIGS. 6A and 6B are schematic diagrams illustrating control brightness examples of light sources.

FIGS. 9A and 9B are schematic diagrams illustrating drive values of light sources determined by a drive value determining unit.

FIGS. 10A and 10B are schematic diagrams illustrating correction coefficient examples of light emission regions.

DESCRIPTION OF THE EMBODIMENTS

Exemplary embodiments of the present disclosure will be described below with reference to the drawings.

First Embodiment

According to a first embodiment, local dimming processing is performed to calculate and save a backlight brightness and a correction coefficient for an image signal for each region so that the reflection time for the backlight brightness is delayed by one frame period from the reflection time for the correction coefficient. This can reduce visual recognition of a flash due to a difference in change rate between the backlight and the liquid crystal.

Figure 1:
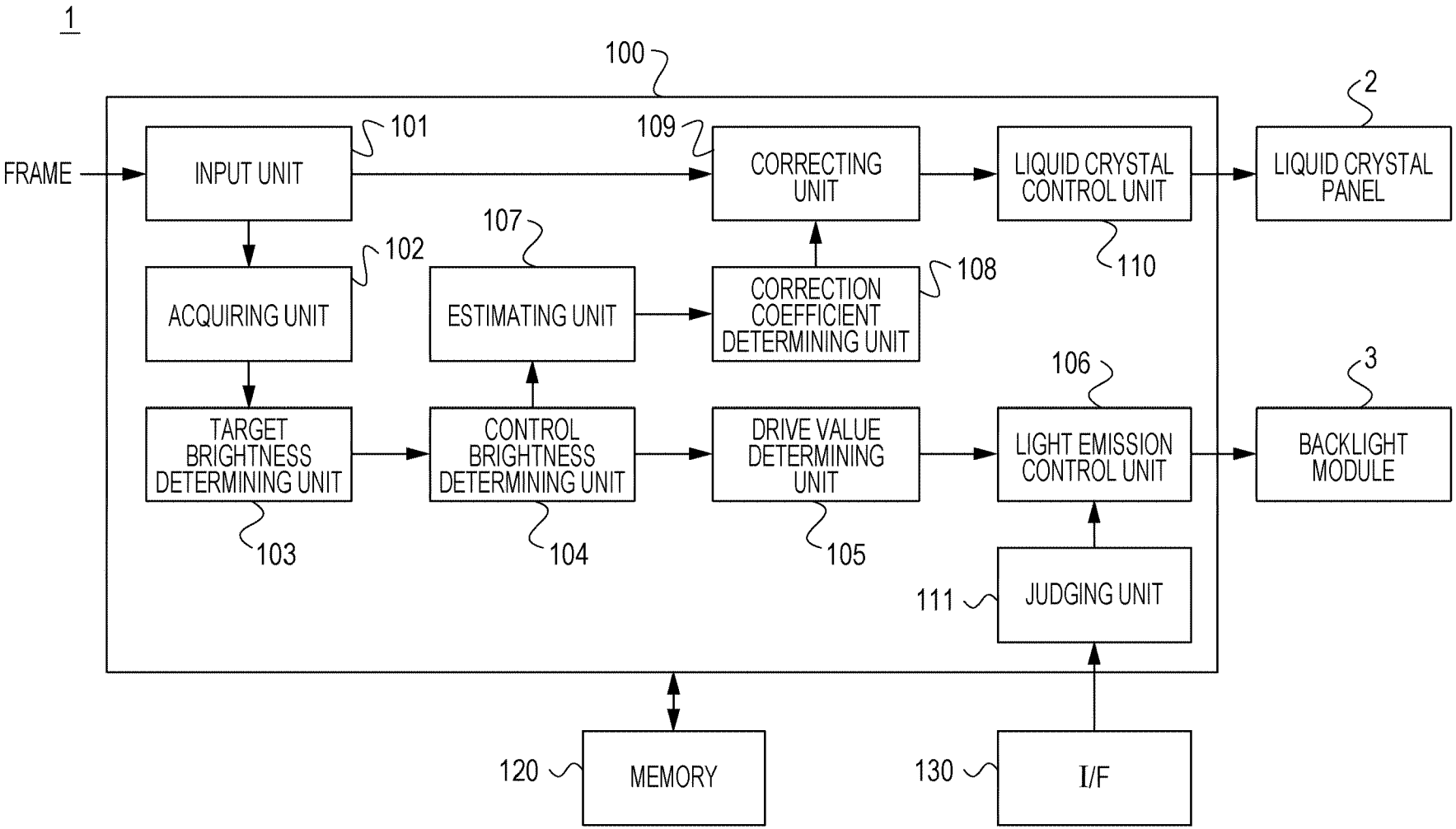
FIG. 1 is a functional block diagram illustrating a display apparatus.

FIG. 1 is a functional block diagram illustrating a display apparatus 1. The display apparatus 1 includes a liquid crystal panel 2, a backlight module 3, a control circuit 100, a memory 120, and an interface (I/F) unit 130.

The liquid crystal panel 2 may be a transmissive display panel configured to display an image on a screen by transmitting light irradiated from a backlight module 3.

The backlight module 3 may be a light emitting device configured to irradiate light from a light emitting surface to the liquid crystal panel 2. The backlight module 3 includes a light source substrate having a plurality of light sources arranged in a matrix form, an optical unit configured to diffuse and irradiate light irradiated from the light sources to the liquid crystal panel 2, and a casing configured to accommodate the light source substrate and the optical unit. The plurality of light sources may be light emitting diodes (LEDs) configured to emit white light. The type of light source is not limited to a white LED. The backlight module 3 may be a cluster light source including a red LED configured to emit a red light beam, a green LED configured to emit a green light beam, and a blue LED configured to emit a blue light beam and emitting a white light beam by blending the light beams emitted from the LEDs. The brightnesses of the light beams emitted from the LEDs may be controlled by pulse width modulation (PWM).

The backlight module 3 can individually control the brightnesses of the light beams irradiated from a plurality of light emission regions being divisions of the light emitting surface. The light emitting surface may be divided into m×n light emission regions (where m and n are integers) including m regions in a horizontal direction and n regions in a vertical direction. For example, m may be equal to 10, and n may be equal to 6. According to this embodiment, the backlight module 3 has light sources corresponding to the light emission regions. The backlight module 3 can individually control the light sources corresponding to the light emission regions to control the brightnesses of the light beams irradiated from the light emission regions.

The control circuit 100, which may include one or more processors and one or more memories, may be a control device configured to control the liquid crystal panel 2 and the backlight module 3 to display an image on a screen of the liquid crystal panel 2. The control circuit 100 includes an input unit 101, an acquiring unit 102, a target brightness determining unit 103, a control brightness determining unit 104, a drive value determining unit 105, a light emission control unit 106, an estimating unit 107, a correction coefficient determining unit 108, a correction unit 109, a liquid crystal control unit 110, and a judging unit 111. Here, the functional blocks of the control circuit 100 may also implement operations, which will be described below, in hardware such as an electronic circuit. According to this embodiment, the control circuit 100 may have one or more processors configured to read out and execute programs for implementing operations of the functional blocks to implement the operations of the functional blocks. The operations of the functional blocks may also be implemented by some of the operations implemented in hardware and some of the other operations implemented by programs executed by the processor(s).

The memory 120 may be a storage medium configured to store programs to be executed by the control circuit 100 and parameters. The memory 120 can temporarily store parameters to be exchanged between the functional blocks of the control circuit 100 and can output them to the functional blocks. The memory 120 may include a plurality of storage media for storing parameters output from a plurality of corresponding functional blocks.

The I/F unit 130 may be a user interface which can be operated by a user. The I/F unit 130 may be a setting screen (On Screen Display or OSD) which is displayed on a screen of a display apparatus and which can be operated by a user, for example. The I/F unit 130 is configured to output a user instruction to the control circuit 100.

The display apparatus 1 has functions which will be described below.

The input unit 101 may be an input unit configured to acquire a plurality of frames that are continuously input. Each of the frames may be images (image signals) having designated pixel values of sub pixels of red color (R), green color (G), and blue color (B) of pixels arranged in a matrix form. It is assumed here that each of the pixel values is represented by 10 bits. The plurality of frames may be input sequentially frame by frame in synchronization with a vertical synchronization signal (Vsync).

The acquiring unit 102 is configured to divide each of input frames to regions corresponding to the light emission regions of the backlight and to acquire some characteristic values of the frame corresponding to the light emission regions. The acquiring unit 102 is configured to output the acquired characteristic values corresponding to the light emission regions to the target brightness determining unit 103. For example, the acquiring unit 102 may acquire, as a characteristic value, a maximum value of RGB pixel values included in a part of a frame corresponding to the light emission regions.

The units described throughout the present disclosure are exemplary and/or preferable modules for implementing processes described in the present disclosure. The term "unit", as used herein, may generally refer to firmware, software, hardware, or other component, such as circuitry or the like, or any combination thereof, that is used to effectuate a purpose. The modules can be hardware units (such as circuitry, firmware, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

Figures 2A, 2B:
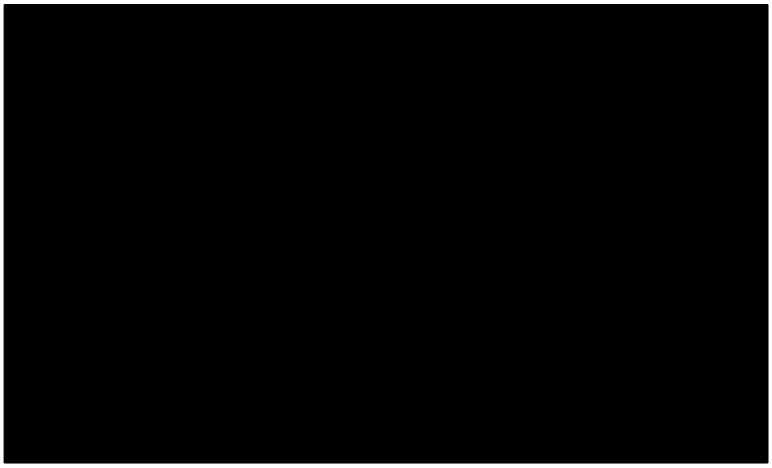
FIGS. 2A and 2B illustrate an image and a first schematic diagram illustrating characteristic values of corresponding light emission regions.

FIGS. 2A and 2B are schematic diagrams illustrating an image a and characteristic values of light emission regions corresponding to the image a. FIG. 2A is a schematic diagram illustrating the image a. The image a has pixels including sub pixels all having a pixel value 0. In other words, the image a may be a black image. FIG. 2B is a schematic diagram illustrating characteristic values of the light emission regions acquired by the acquiring unit 102 based on the image a. FIG. 2B illustrates horizontal and vertical coordinates of the light emission regions having values 1 to 10 in the horizontal direction and having values 1 to 6 in the vertical direction. Because the image a have pixel values corresponding to black, the characteristic values of the light emission region are all 0.

Figures 3A, 3B:
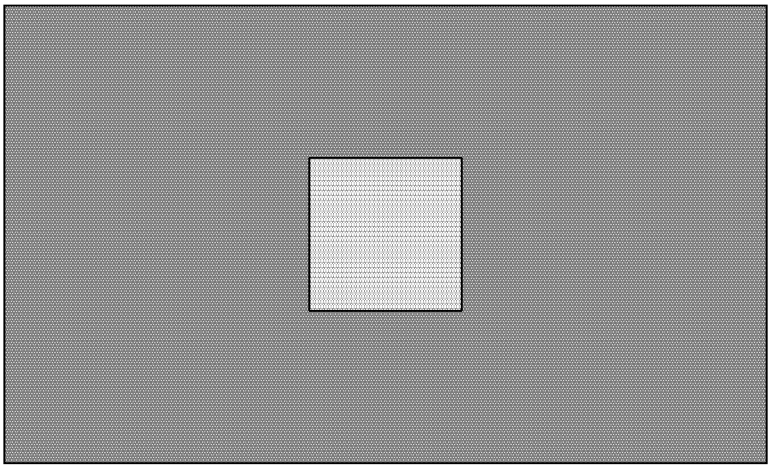
FIGS. 3A and 3B illustrate an image and a second schematic diagram illustrating characteristic values of corresponding light emission regions.

FIGS. 3A and 3B are schematic diagrams illustrating an image b and characteristic values of light emission regions corresponding to the image b. FIG. 3A is a schematic diagram illustrating the image b. The image b has a rectangular object at its center with a gray background. Here, the background has pixel values all equal to 512 in RGB, and the object at the center has pixel values all equal to 800. FIG. 3B is a schematic diagram illustrating characteristic values of the light emission regions acquired by the acquiring unit 102 based on the image b.

The target brightness determining unit 103 is configured to determine a target value of the brightness (target brightness) of a light beam emitted from each light emission region based on the characteristic value of the light emission region acquired by the acquiring unit 102. The target brightness determining unit 103 may read out a table showing a relationship between characteristic value and target brightness from the memory 120 and determine the target brightness of each light emission region with reference to the table.

Figure 4:
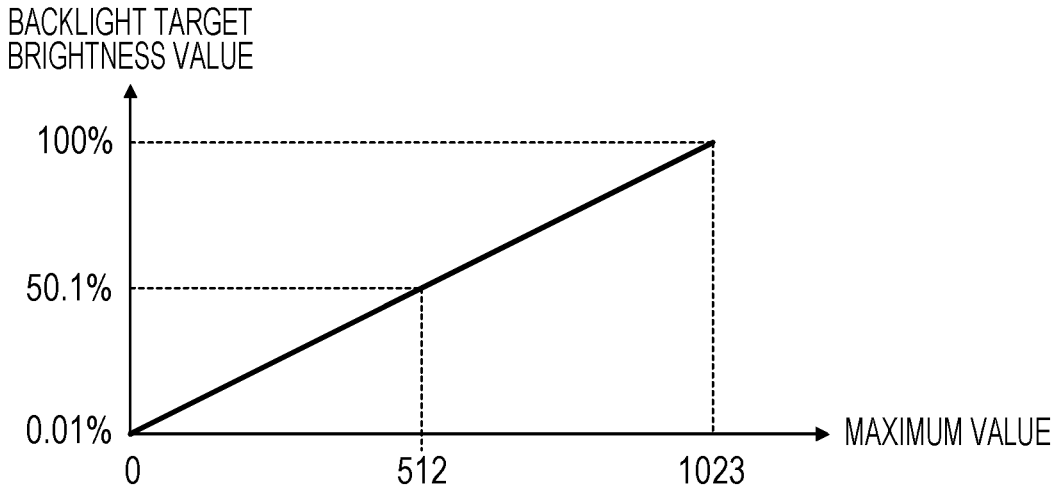
FIG. 4 is a schematic diagram illustrating a table example presenting a relationship between characteristic value and target brightness.

FIG. 4 is a schematic diagram illustrating a table showing a relationship between characteristic value and target brightness. FIG. 4 has a horizontal axis representing characteristic value. FIG. 4 further has a vertical axis representing target brightness. A target brightness of 0% indicates a brightness of light emitted from a light emission region when the corresponding light source does not light up. A target brightness of 100% indicates a brightness of light emitted from a light emission region when the corresponding light source lights up with a maximum brightness. This embodiment assumes that 0.01% is a target brightness when the characteristic value exhibits a lower limit value (0) and that 100% is a target brightness when the characteristic value exhibits an upper limit (1023). When the characteristic value exhibits a value between the lower limit value and the upper limit value, the corresponding target brightness is determined based on a relationship represented by a linear connection of the target brightnesses.

FIGS. 5A and 5B are schematic diagrams illustrating target brightnesses of light emission regions determined based on the images. FIG. 5A is a schematic diagram illustrating target brightnesses of light emission regions determined based on the image a. Referring to FIG. 2B, because the light emission regions corresponding to the image a have characteristic values all equal to 0, the light emission regions have a target brightness of 0.01%.

FIG. 5B is a schematic diagram illustrating target brightnesses of light emission regions determined based on the image b. The target brightness determining unit 103 defines a target brightness of 78.2% for light emission regions corresponding to the part including the object at the center of the image b. The target brightness determining unit 103 defines a target brightness of 50.1% for light emission regions corresponding to the part corresponding to the background (excluding the object) of the image b. The target brightness determining unit 103 outputs the target brightnesses for the light emission regions to the control brightness determining unit 104.

The control brightness determining unit 104 determines brightnesses (control brightnesses) of light beams emitted from the light sources corresponding to the light emission regions based on the target brightnesses for the light emission regions determined by the target brightness determining unit 103 and the upper limit value (set brightnesses) of the display brightness set by a user. This embodiment assumes that the set brightness is equal to 1000 cd/m$^2$.

The absolute value of the brightness of light emitted from a light emission region having a target brightness of 100% is determined based on the set brightness and the maximum value of the transmittance of the liquid crystal panel 2. In a case where the maximum value of the transmittance of the liquid crystal panel 2 is 10% and where the set brightness is 1000 cd/m$^2$, the absolute value of brightness of light emitted from light emission regions with a target brightness of 100% is equal to 10000 cd/m$^2$ where the target brightness for the backlight is 100%.

In a case where the backlight module 3 is a direct-type backlight module 3 provided on a back side of the liquid crystal panel 2, light diffuses among light emission regions. In other words, light emitted from a light source corresponding to one light emission region is diffused to neighborhood light emission regions. Therefore, the control brightness of light sources of light emission regions may be determined in consideration of an influence of light (leakage of light) diffused from a neighborhood light emission region.

The control brightness determining unit 104 may determine a control brightness of each light source in consideration of an influence of leakage of light. The control brightness determining unit 104 may determine a light emission brightness (provisional light emission brightness) for light sources corresponding to light emission regions in proportion to the target brightnesses for the light emission regions. Then, when all of the light sources are lighted up with the provisional light emission brightness, the brightness (provisional incident brightness) of light incident on the liquid crystal panel is acquired in consideration of an influence of the leakage of light.

An attenuation coefficient at each estimation point is acquired in advance from the brightness of light incident upon the estimation point of a light emission region when the light source corresponding to a certain light emission region is lighted up and is saved in the memory 120. The control brightness determining unit 104 multiplies the attenuation coefficient read out from the memory 120 by the provisional light emission brightnesses of light sources and adds all of the multiplication results to acquire a provisional incident brightness at each estimation point. It is assumed here that the estimation point is at a center position of each light emission region. In a case where there is a light emission region having a provisional incident brightness which does not satisfy its target brightness, the provisional light emission brightnesses of the light sources may be multiplied by an equal coefficient uniformly for increased brightnesses such that the provisional incident brightnesses of all of the light emission regions can satisfy their target brightnesses. Thus, the control brightnesses for the light sources can be acquired.

FIGS. 6A and 6B are schematic diagrams illustrating control brightnesses for light sources. FIGS. 6A and 6B illustrate a case where the brightnesses are set to 1000 cd/m$^2$. FIG. 6A is a schematic diagram illustrating control brightnesses for light sources determined based on the image a. The target brightness determined based on the image a is equal to 0.01% in each of light emission regions. In a case where all light emission regions have an equal brightness, influences of leakages of light can complement each other. The control brightness for the light sources is determined as 1 cd/m$^2$ that is 0.01% of 10000 cd/m$^2$.

FIG. 6B is a schematic diagram illustrating control brightnesses for light sources determined based on the image b. The target brightness determined based on the image b is equal to 78.2% in light emission regions corresponding to parts of frames including the object at the center, and the target brightness for the other light emission regions is equal to 50.1%. In this manner, as a result of the determination of the control brightnesses for the light sources, the control brightnesses for the light sources corresponding to the light emission regions are determined as illustrated in FIG. 6B.

The control brightness determining unit 104 outputs the control brightnesses for the light sources to the drive value determining unit 105 and the estimating unit 107. It should be noted that the set brightness may be selected by a user through the I/F unit 130.

Figures 7, 8:
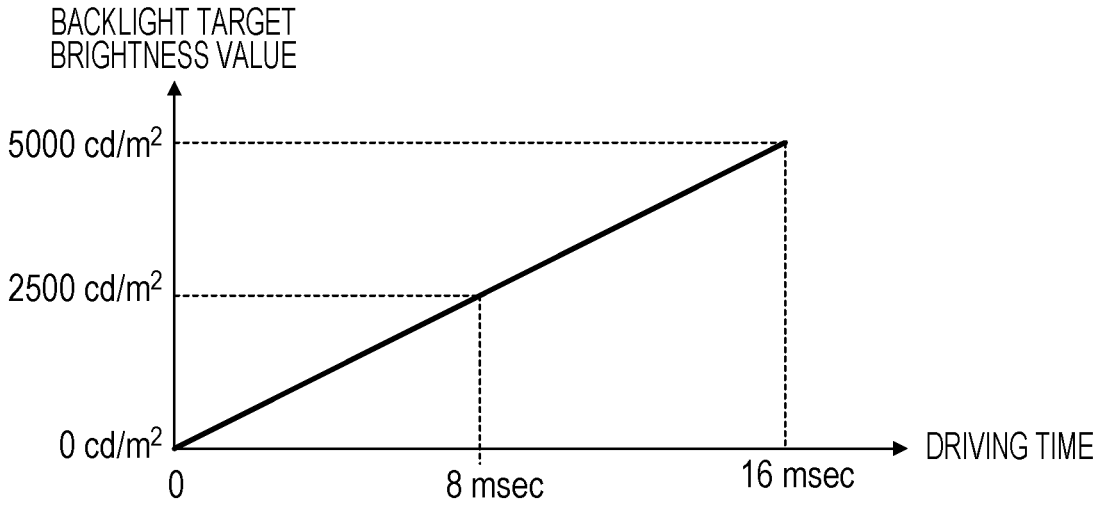
FIG. 7 is a schematic diagram illustrating a relationship between control brightness and driving time.
FIG. 8 is a schematic diagram illustrating luminous efficiency of light sources.

The drive value determining unit 105 is configured to determine a drive value representing a driving time for each light source based on the control brightness for the light source received from the control brightness determining unit 104. As described above, according to this embodiment, each of the light sources is an LED, and its brightness is under PWM control. The driving time is a length of a light up period during one frame period under PWM control. FIG. 7 is a schematic diagram illustrating a relationship between control brightness and driving time. The control brightness and the driving period may be proportional. A drive value for each light source is temporarily determined based on the control brightness for the light source.

FIG. 8 is a schematic diagram illustrating luminous efficiency of each light source. The luminous efficiencies of light sources are independent from each other and are not necessarily equal. Therefore, in order to output a correct control brightness, a drive value is corrected in consideration of the luminous efficiency of each pixel. FIG. 8 illustrates luminous efficiencies of light sources with reference to 1.00. A light source having a luminous efficiency of 1.00 satisfies the relationship between control brightness and driving period illustrated in FIG. 7. A light source having a luminous efficiency of 1.01 has a higher luminous efficiency by 1% than the light source having of 1.00. In other words, when those light sources are lighted up with an equal control brightness, the light source having a luminous efficiency of 1.01 may use a shorter driving period.

For example, when the control brightness is 5000 cd/m$^2$, the driving period of the light source having a luminous efficiency of 1.00 is 16 msec. On the other hand, the driving period of the light source having a luminous efficiency of 1.01 is 15.84 msec (16÷1.01). The driving period of the light source having a luminous efficiency of 0.99 is 16.16 msec (16÷0.99).

The drive value determining unit 105 determines a drive value for each of light sources in consideration of the luminous efficiency of the light source. FIGS. 9A and 9B are schematic diagrams illustrating drive values for light sources determined by the drive value determining unit 105. FIG. 9A is a schematic diagram illustrating drive values for light sources determined based on the image a. FIG. 9B is a schematic diagram illustrating control brightnesses for the light sources determined based on the image b. The drive value determining unit 105 outputs drive values for the light sources to the light emission control unit 106.

The light emission control unit 106, which may include one or more processors and one or more memories, may be configured to drive the light sources for the backlight module 3 based on the acquired drive values for the light sources. Here, the drive value determining unit 105 starts controlling the light emission of the backlight module 3 at a first time by using the drive values for the light sources determined based on a certain frame. The drive value determining unit 105 controls the backlight module 3 such that the first time can be later than a second time for starting control of transmittance of the liquid crystal panel 2 based on a frame to be corrected by using an image correction value determined based on the certain frame. Operations of the drive value determining unit 105 will be described in detail below.

The estimating unit 107 is configured to estimate the brightness (irradiation brightness) of light to enter to the liquid crystal panel 2 when the light sources in the backlight module 3 are lighted up with their control brightnesses, like the calculation of the irradiation brightnesses performed by the control brightness determining unit 104. The brightness may be estimated for a central point in a region according to this embodiment. The estimation results for the estimation points are output to the correction coefficient determining unit 108.

The correction coefficient determining unit 108 is configured to receive results of the brightness estimations performed by the estimating unit 107 and acquire a correction coefficient for image signals. It may be important for a business monitor to precisely display the brightness that is proper for an input frame. Accordingly, the correction coefficient here is a coefficient to be multiplied by a frame in the subsequent correction unit 109 to compensate variations of the display brightness due to variations of brightness of light irradiated from the backlight module. In a case where the estimated brightness at a certain point is Lpn, a target brightness value for decompressing/adjusting the correction coefficient is Lt, and the correction coefficient for a target point is Gpn, the correction coefficient Gpn can be calculated by the following Expression (1). It is assumed here that the target brightness Lt is 100%.

$$Gpn=Lt/Lpn \quad (1)$$

FIGS. 10A and 10B are schematic diagrams illustrating correction coefficients for light emission regions. FIG. 10A is a schematic diagram illustrating correction coefficients for light emission regions determined based on the image a. When the light sources are lighted up with control brightnesses determined based on the image a, the control brightnesses for all of the light source are controlled uniformly to 0.01%, and the estimated brightness Lpn is 0.01% in consideration of leakage of light. Therefore, the correction coefficient is 100(%)÷0.01(%)=10000. On the other hand, FIG. 10B is a schematic diagram illustrating correction coefficients for light emission regions determined based on the image b. The image b has a bright object at its center, and the background region has a half tone (gray). Therefore, the control brightnesses for the light sources vary in accordance with the position. As the distance from the background region to the central bright region decreases, the brightness of the background region increases to be higher than the target brightness under influence of leakage of light from the central bright light emission region. Therefore, as illustrated in FIG. 10B, while the correction coefficient of an end region of a screen doubles, the correction coefficient of the region closer to the center is smaller than the double.

The thus acquired correction coefficients are output to the correction unit 108. The correction coefficients determined by the correction coefficient determining unit 108 are output to the correction unit 10 in response to a Vsync signal. According to this embodiment, for an input frame, the acquiring unit 102 acquires characteristic values, and the control brightness determining unit 104 determines the control brightnesses for the light sources based on the characteristic values. The correction coefficient determining unit 108 executes the processing for determining the correction coefficients within a frame period of an input frame.

The correction unit 109 corrects a frame by using a correction coefficient determined by the correction coefficient determining unit 108 to generate a display frame. Because the brightness is estimated for random pixels, the brightness for a pixel between the estimation points is acquired by interpolation based on the values of the surrounding estimation points. The correction unit 109 is configured to correct continuously input frames by using correction coefficients. The correction unit 109 generates a display frame by using correction coefficients determined based on a frame before the input frame to be displayed. The correction unit 109 outputs the display frame to the liquid crystal control unit 110.

The liquid crystal control unit 110 is a display control circuit configured to control the transmittance of the liquid crystal pixels in the liquid crystal panel 2 to display an image based on display frames. The liquid crystal control unit 110 starts controlling the transmittance of liquid crystal pixels in the liquid crystal panel 2 based on display frames in response to input of the display frames thereto. The timing for controlling the transmittance by the liquid crystal control unit 110 will be described below.

The judging unit 111 is a judgment processing circuit configured to judge an upper limit value for a display apparatus and an operating mode designated by a user based on information input by the user. Operations to be performed by the judging unit 111 will be described in detail with reference to second and subsequent embodiments.

Figure 11A:
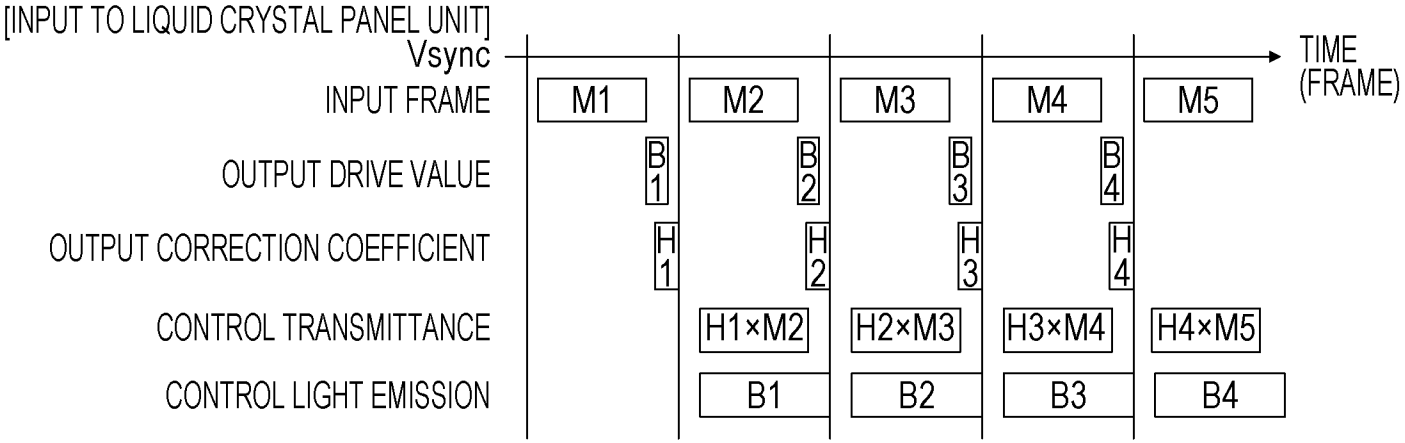
FIGS. 11A and 11B are timing charts illustrating frames input to a display apparatus and operation times of functional blocks in the display apparatus.
Figure 11B:
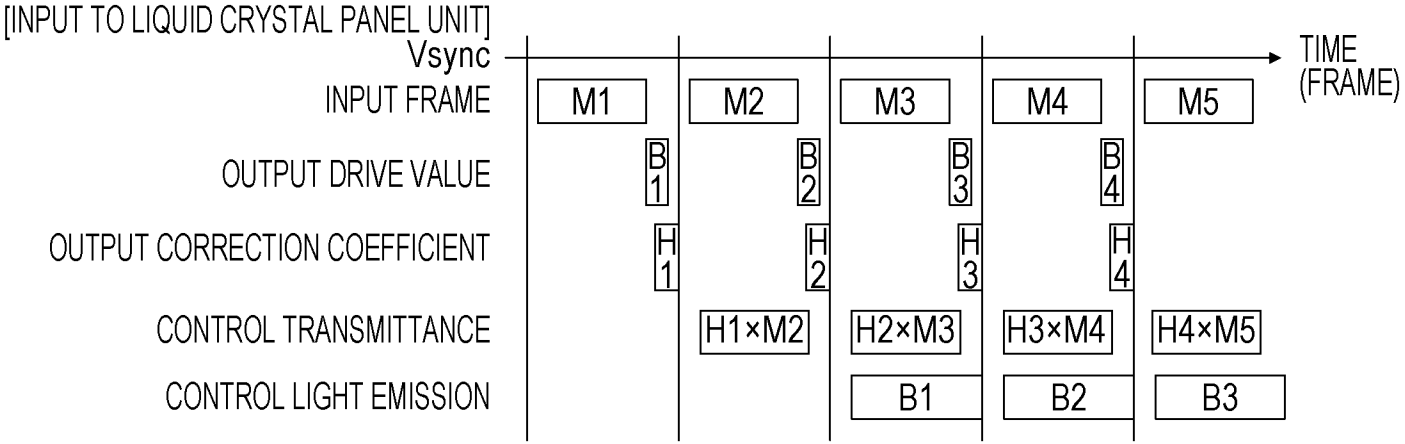

FIGS. 11A and 11B are timing charts illustrating frames input to the display apparatus 1 and operating times of the functional blocks in the display apparatus 1. FIGS. 11A and 11B have a horizontal axis indicating a time period (frame). FIGS. 11A and 11B further have a vertical axis indicating times for, in order from the above, a vertical synchronization signal, an input frame, output from the drive value determining unit 105, output from the correction coefficient determining unit 108, output from the correction unit 109 (transmittance control by the liquid crystal control unit 110), and output from the light emission control unit 106. Numbers given to the illustrated items indicate input frame numbers. For example, a drive value for a light source determined based on a frame M1 is B1, and a correction coefficient determined based on the frame M1 is H1.

FIG. 11A illustrates a timing chart for executing a control according to this embodiment. Frames M1, M2, and M3 are sequentially input in response to Vsync signals. A period between Vsync signals corresponding to the frames is called a frame period. Drive values B1, B2, and B3 and correction coefficients H1, H2, and H3 corresponding to the frames are determined during a blanking period in which an image signal is input among the frame periods of frames.

The correction coefficient H1 determined based on the frame M1 is used for correcting the frame M2 input after the frame M1. In other words, the correction coefficient H1 determined based on the frame M1 is used for correcting the frame M2 immediately following the frame M1. The correction unit 109 corrects the frame M2 by using the correction coefficient H1 determined based on the frame M1. The liquid crystal control unit 110 starts controlling the transmittance of the liquid crystal panel based on the corrected frame M2 (display frame H1×M2) at a substantially same time as that of the Vsync when the frame M2 is input.

On the other hand, the light emission control unit 106 starts controlling the light emission of the light sources at a substantially same time as the time when the control over the transmittance of the liquid crystal panel is started based on the corrected frame M3 (display frame H2×M3) by using the drive value B1 determined based on the frame M1.

In other words, it is controlled such that the time for starting the control over the light emission of the light sources by using the drive value B1 based on the frame M1 is later than the time for starting the control over the transmittance of the liquid crystal panel by using the correction coefficient H1 based on the frame M1.

FIG. 11B is a timing chart in a case where a control according to a comparison example is executed. According to the comparison example, the time for starting the control over the light emission of the light sources by using the drive value B1 based on the frame M1 is equal to the time for starting the control over the transmittance of the liquid crystal panel by using the correction coefficient H1 based on the frame M1. In other words, the time for starting the control over the transmittance of the liquid crystal panel based on the frame M2 (H1×M2) corrected with the correction coefficient H1 is equal to the time for starting the control over the light emissions of the light sources in the backlight module 3 by using the drive value B1.

FIGS. 12A to 12E are schematic diagrams for explanation of effects of the control according to this embodiment. Here, the frame M1 and the frame M2 are included in the image a, and the frame M3 and subsequent frames are included in the image b. It is assumed here that frames input before the frame M1 are included in the image a. In other words, the image a is changed to the image b between the frame M2 and the frame M3. The following description focuses on a region of the liquid crystal panel corresponding to the light emission region (4,3), the brightness of the light source, and the brightness (display brightness) of the light passing through the liquid crystal panel.

Figure 12A:
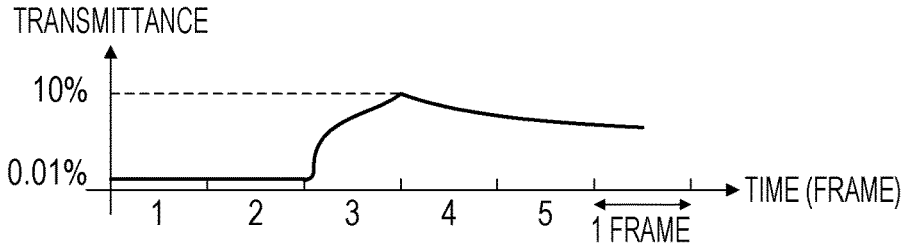
FIGS. 12A to 12E are schematic diagrams explaining effects of control according to an embodiment.

FIG. 12A is a schematic diagram illustrating changes of transmittance of a region of the liquid crystal panel corresponding to a certain light emission region under the control according to this embodiment. FIG. 12A has a horizontal axis indicating time and a vertical axis indicating transmittance. Numbers 1 to 5 on the horizontal axis correspond to frames. A maximum value and a minimum value of the transmittance of the liquid crystal pixel are 10% and 0.01%, respectively. With a maximum pixel value, the transmittance is at a maximum.

A black image based on the frames M1 and M2 is displayed on the region. As described above, the correction coefficients H1 and H2 acquired from the frames are 10000 times. On the other hand, because the pixel values of the region on the frames M1 and M2 are 0 (black signal), the pixel value of the region corrected by using the correction coefficient is still 0.

When the frame M3 is input, the frame M3 is corrected with the correction coefficient H2 based on the frame M2. On the frame M3, the region has a pixel value of 512. Thus, correcting the frame M3 by using the correction coefficient H2 results in 1023 tones at a maximum. However, the liquid crystal pixels of the liquid crystal panel 2 are delayed until the transmittance corresponding to the pixel value of the frame is acquired. For example, one frame period may be used for the liquid crystal pixels of the liquid crystal panel 2 to acquire the transmittance corresponding to the pixel value. Thus, during the frame period 3, the transmittance of the liquid crystal panel 2 gradually increases.

When the frame M4 is input, the frame M4 is corrected with the correction coefficient H3 based on the frame M3. It is assumed here that the correction coefficient H3 is equal to 1.5. Correcting the frame M4 by using the correction coefficient H3 results in the region having a pixel value of 768 tones. It is assumed that the same pixel value is designated for the frame M4 and the subsequent frames. In response to the change of the pixel value of the region from 1023 to 768, the liquid crystal control unit 110 controls to reduce the transmittance. Because the responsiveness of the transmittance of the liquid crystal pixels may involve one or more frame periods as described above, the change of the transmittance does not finish in the frame period corresponding to the frame M4, but the transmittance keeps changing to the middle of the frame period corresponding to the frame M5.

Figure 12B:
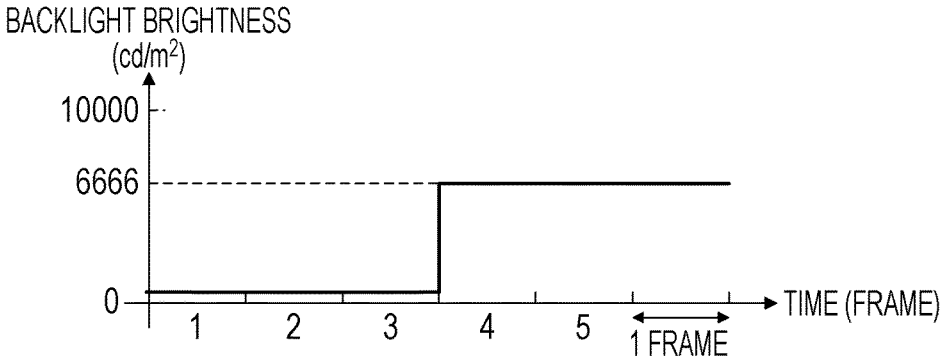

Next, a change of the irradiation brightness at the light emission region (4,3) of the backlight module 3 will be described. FIG. 12B is a schematic diagram illustrating a change of the irradiation brightness according to a comparison example. In other words, FIG. 12B illustrates a change of the irradiation brightness in a case where the time for starting the control over the transmittance of the liquid crystal panel based on the frame corrected with the correction coefficient based on a certain frame is equal to the time for starting the control over the light emissions of the light sources by using a drive value based on the certain frame. In this case, it can be described that the time delay is set to 0.

When the timing delay is set to 0, the light emission control unit 106 controls the light emissions of the light source by using the drive value B1 based on the frame M1 during the frame period of the corrected frame M2. The light emission control unit 106 controls the light emissions of the light sources by using the drive value B2 based on the frame M2 during the frame period of the corrected frame M3. Also during the subsequent frames, the light emission control unit 106 controls the light emissions of the light sources by using the drive value based on the one previous frame of the frame to be displayed. Thus, the brightness of light irradiated to the region of the liquid crystal panel 2 corresponding to the light emission region (4,3) is 1 cd/m$^2$ up to the frame M3 and is changed to 6666 cd/m$^2$ from the frame M4.

Figure 12C:
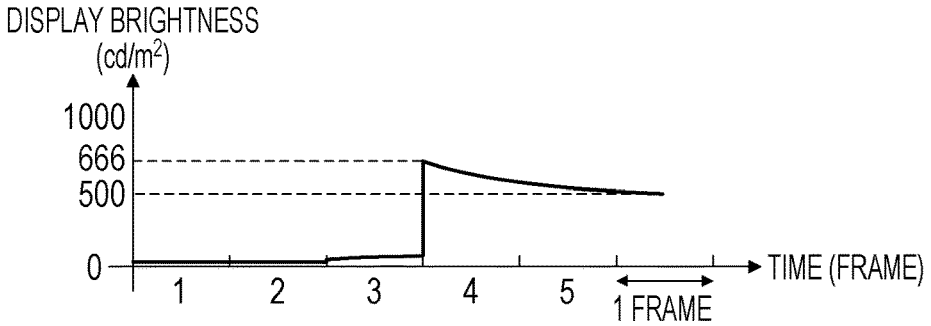

FIG. 12C is a schematic diagram illustrating changes of a display brightness according to a comparison example. The display brightness is a value acquired by multiplying the irradiation brightness by the transmittance of the liquid crystal. When an image based on the frames M1 and M2 is displayed, the display brightness is equal to 0.01 cd/m$^2$. When an image based on the frame M3 is displayed, the transmittance gradually increases to a maximum value. Because the irradiation brightness is still equal to 0.01 cd/m$^2$, the display brightness gradually increases from 0.01 cd/m$^2$.

When an image based on the frame M4 is displayed, the irradiation brightness increases to 6666 cd/m$^2$. On the other hand, the transmittance of the liquid crystal panel is equal to a value close to the transmittance produced when the frame M3 is displayed. Therefore, the display brightness increases to 666 cd/m$^2$ once and then decreases gradually to 500 cd/m$^2$. In this case, a user may visually recognize a temporary increase of the display brightness such as a flashlight when the frame M3 is changed to the frame M4.

Figure 12D:
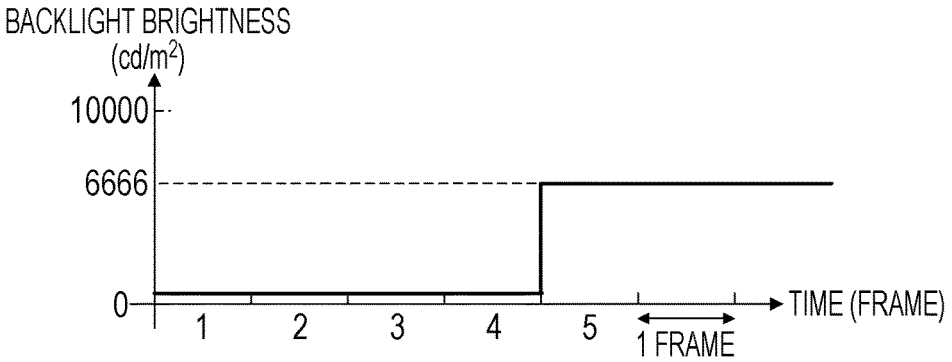

FIG. 12D is a schematic diagram illustrating a change of irradiation brightness in a case where the processing according to this embodiment is executed. In other words, FIG. 12D illustrates a change of irradiation brightness in a case where the time for starting the control over the light emissions of the light sources by using a drive value based on a certain frame is later than the time for starting the control over the transmittance of the liquid crystal panel based on a frame corrected with a correction coefficient based on the certain frame. In this case, it can be described that the time delay is set to 1.

When the timing delay is set to 1, the light emission control unit 106 controls the light emissions of the light source by using the drive value B1 based on the frame M1 during the frame period of the corrected frame M3. The light emission control unit 106 controls the light emissions of the light sources by using the drive value B2 based on the frame M2 during the frame period of the corrected frame M4. Also during the subsequent frames, the light emission control unit 106 controls the light emissions of the light sources by using the drive value based on the two previous frame of the frame to be displayed. Thus, the brightness of light irradiated to the region of the liquid crystal panel 2 corresponding to the light emission region (4,3) is 1 cd/m$^2$ up to the frame M4 and is changed to 6666 cd/m$^2$ from the frame M5.

Figure 12E:
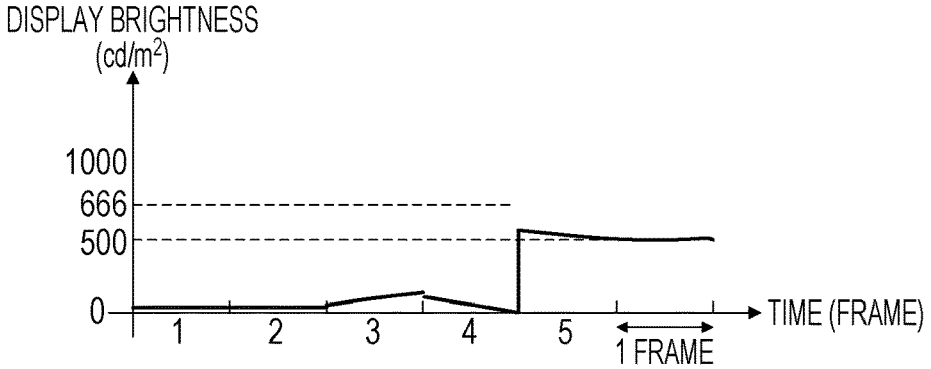

FIG. 12E is a schematic diagram illustrating changes of a display brightness in a case where the processing according to this embodiment is executed. When an image based on the frames M1 and M2 is displayed, the display brightness is equal to 0.01 cd/m$^2$. When an image based on the frame M3 is displayed, the transmittance gradually increases to a maximum value. Because the irradiation brightness is kept at 0.01 cd/m$^2$, the display brightness gradually increases from 0.01 cd/m$^2$.

When an image based on the frame M4 is displayed, the transmittance gradually decreases. Because the irradiation brightness is still equal to 0.01 cd/m$^2$, the display brightness gradually decreases. When an image based on the frame M5 is displayed, the irradiation brightness increases to 6666 cd/m$^2$. On the other hand, because the transmittance of the liquid crystal panel decreases gradually during a frame period corresponding to the frame M3, it is controlled to acquire a value closer to the transmittance substantially corresponding to the pixel value of the image. Therefore, the display brightness decreases once from a value close to 500 cd/m$^2$ gradually to 500 cd/m$^2$. This can prevent an increase of brightness such as a flash occurring upon frame switching as illustrated in FIG. 11C.

In this manner, a sense of disturbance such as a flash can be suppressed by delaying the reflection time of the brightness of the backlight from the time for correcting an image signal during local dimming processing.

According to this embodiment, the time for controlling the backlight module by using a drive value based on a certain frame is delayed by one frame period from the time for using a correction coefficient based on the certain frame for correcting the frame. However, the amount of delay is not limited thereto. The amount of delay for the time can be adjusted as desired in accordance with the response speed of the transmittance of the liquid crystal panel. Because data are sequentially rewritten in the vertical direction on the liquid crystal pixels arranged in a matrix form, the control over the transmittance of the liquid crystal panel may be determined based on the rewriting time and the response speed of transmittance for each region in consideration of the time for rewriting on a lighted region.

When the frame rate of input frames changes, the time period of one frame changes on the liquid crystal panel. Therefore, the control may be determined based on the frame rate. For example, one frame is 16.7 msec long with a frame rate of 60 Hz while it is 41.7 msec long with 24 Hz. When 1 frame delay is properly set with a frame rate of 60 Hz, a 0.4 frame may be set with 24 Hz because 1 (frame)× 16.7/41.7=0.4.

Second Embodiment

According to the first embodiment, an amount of delay for the time for controlling a backlight module by using a drive value based on a certain frame is uniformly determined with respect to the time for using a correction coefficient based on the certain frame for correcting the frame. However, with a large amount of delay, an afterglow may possibly occur when a scene change happens, for example, from a bright scene to a dark scene because the backlight goes off after a delay of one frame. According to a second embodiment, scenes of images are judged, and the driving time is adjusted only for a scene in which a sense of disturbance such as a flash can be easily recognized.

A display apparatus according to the second embodiment includes functional blocks which are identical to those of the first embodiment. The display apparatus according to the second embodiment is different from the display apparatus according to the first embodiment in processing to be performed by the judging unit 111 and the light emission control unit 106. Because the other functional blocks perform the same operations as those of the first embodiment, any repetitive description will be omitted.

The judging unit 111 is configured to judge a change of a scene in which a flash phenomenon may easily occur and output a judgment result to the memory 120. The judging unit 111 is further configured to compare a characteristic value of a current frame input from the acquiring unit 102 and a characteristic value of a previous frame saved in the memory 120 to judge a change of the scene.

It is assumed that an average value of maximum values of some of pixel values of frames corresponding to light emission regions of the previous frame read from the memory 120 characteristic value is AveMax(−1). It is further assumed that an average value of maximum values of some of pixel values of frames corresponding to light emission regions in the current frame acquired by the acquiring unit 102 is AveMax(0). A flash phenomenon can easily be seen when a darker scene is changed to a scene having a half tone or a higher tone. Thus, the judging unit 111 judges a change of a scene in which a flash phenomenon may easily occur if AveMax(−1) is equal to or lower than a dark part threshold value and if AveMax(0)−AveMax(−1) is equal to or higher than a difference threshold value. It is assumed that the dark part threshold value is Thl_Max. It is further assumed that the difference threshold value is dMax.

Having described that the maximum value is used as the characteristic value according to this embodiment, an average value of a whole screen may be used for the judgment. Instead of the characteristic value, a change from a scene having a lower backlight brightness to a scene having a higher backlight brightness, not illustrated, may be detected for the judgment. In this case, an output result of one of the target brightness determining unit 103, the control brightness determining unit 104, and the drive value determining unit 105 may be used for the judgment.

The judging unit 111 is configured to output a judgment result to the light emission control unit 105. If a scene in which a flash phenomenon may easily occur is identified, the light emission control unit 105 defines one frame period for an amount of delay. If not, the light emission control unit 105 defines zero frame period for the amount of delay not to shift the time.

Figure 13:
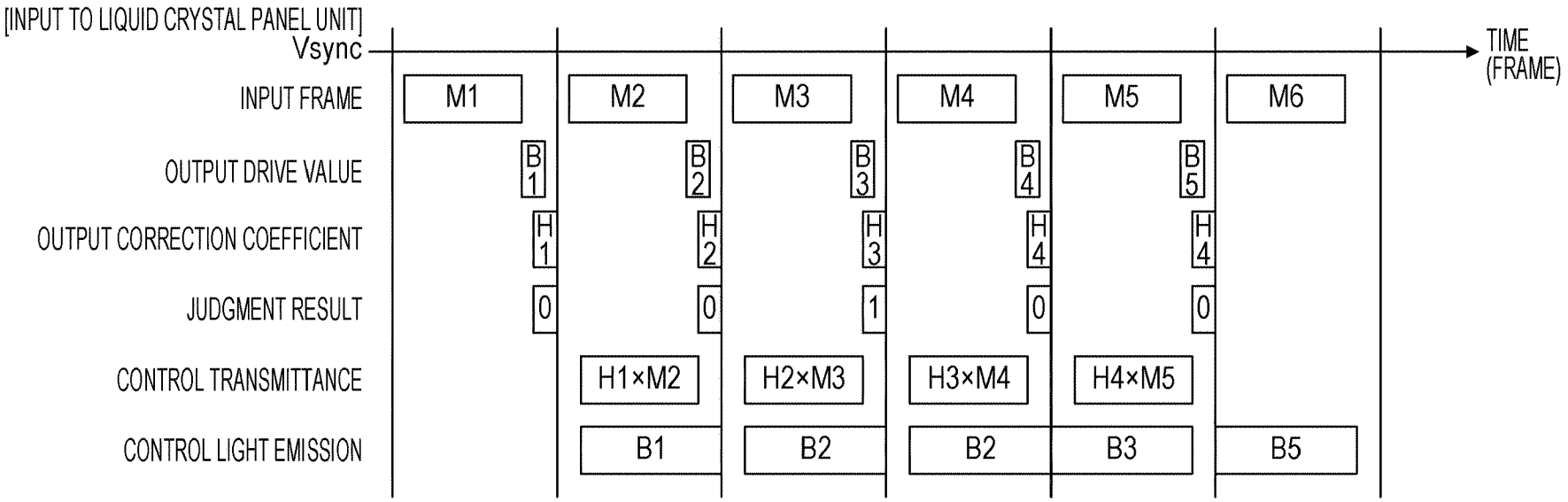
FIG. 13 is a timing chart illustrating frames input to a display apparatus and operating times of functional blocks in a display apparatus.

FIG. 13 illustrates a timing chart in a case where a control according to the second embodiment is executed. The timing chart in FIG. 13 further illustrates judgment results in addition to the timing chart in FIG. 10. When a frame M2 is changed to a frame M3 in FIG. 13, it may be judged that there is a scene change in which a flash phenomenon may easily occur. In this case, the amount of delay is changed from zero frame period to one frame period. In this case, when a display frame H3×M4 is displayed, a drive value (B2) based on the two previous frame M2 is used. On the other hand, when the frame M3 is changed to the frame M4, it may be judged that there is a scene change in which a flash phenomenon may easily occur. In this case, the amount of delay is changed from one frame period to zero frame period. In this case, when a display frame H4×M5 is displayed, a drive value B4 based on one previous frame M4 is used.

When a scene change occurs in which a sense of disturbance such as a flash can easily be recognized, the time for controlling the backlight by using a drive value based on a certain frame is delayed with respect to the time for controlling the transmittance of a frame corrected by using a correction coefficient based on the certain frame. Thus, a sense of disturbance such as a flash can be inhibited, and a state that an afterglow can easily be seen can be prevented.

According to this embodiment, the reflection time is limitedly shifted when a dark scene is changed to a bright scene. However, embodiments of the present disclosure are not limited thereto. For example, the brightness may largely change locally from a low brightness to a high brightness when a scene change occurs. Therefore, the reflection time may be shifted also when a scene change excluding a scene change with an easily recognizable afterglow occurs. Alternatively, a change from a bright scene having an easily recognizable afterglow to a dark scene may be detected, and the reflection time may only be shifted upon detection of the change. The process for shifting the reflection time is also applicable to superimposition of an OSD (ON-screen display) displaying a user operation and information on a dark scene.

Third Embodiment

According to a third embodiment, the reflection time is set based on the display brightness set by a user.

A display apparatus according to the third embodiment includes functional blocks which are identical to those of the first embodiment. Therefore, any repetitive detail description will be omitted. In the display apparatus according to the third embodiment, the judging unit 111 dynamically controls a threshold value for the judgment of a scene change based on an upper limit value of the display brightness of the display apparatus set by a user.

The judging unit 111 is configured to change threshold values Thl_Max and dMax to be used for scene judgment based on the set upper limit of display brightness. For example, when the upper limit value of the display brightness is as low as 100 cd/m$^2$, the amount of change of the brightness of the backlight is 1/10 of 1000 cd/m$^2$. This can prevent easy recognition of a flash phenomenon. Thus, scenes can be narrowed, compared with a scene having a brightness of 1000 cd/m$^2$. Therefore, as the set upper limit value of the display brightness decreases, the threshold value Thl_Max decreases. Conversely, the threshold value dMax increases. Therefore, when the upper limit value of the display brightness is low, a scene change in which a flash phenomenon can easily occur can be judged limitedly when a darker scene is changed to a bright scene, compared with the upper limit value of the display brightness is high.

The third embodiment has been described in detail up to this point. With the configuration as described above, a shift of the reflection time is set for a scene in which a flash phenomenon can easily be recognized based on the upper limit value of the display brightness. Thus, when the display brightness is changed, scenes in which a flash phenomenon can easily be visually recognized can be limited more than the second embodiment, which can prevent an afterglow from being easily recognized. Having described that, according to this embodiment, the reference value for the scene judgment is changed based on the display brightness, the delay of the reflection time may be determined based on the display brightness. A delay of the reflection time may be determined based on the set display brightness. For example, when the display brightness is set in a range of 300 to 1000 cd/m$^2$, a delay of one frame may be set for the reflection time. When the display brightness is set in a rage of 0 to 300 cd/m$^2$, a delay of zero frame (or no delay of the reflection time) may be set. Because the range of easily visually recognizable display brightness depends on liquid crystal pixels of a liquid crystal panel to be used, embodiments are not limited thereto. Therefore, for example, the range of easily visually recognizable display brightness may differ between use of HDR (high dynamic range) display with a PQ (perceptual quantizer) signal standardized as ST2084 in SMPTE or an HLG (hybrid log-gamma) signal standard as BT.2100 and the other conventional display mode (where SMPTE is Society of Motion Picture and Television Engineers).

Fourth Embodiment

According to a fourth embodiment, a user may set the reflection time based on the display mode of a display apparatus. A display apparatus according to the fourth embodiment includes functional blocks which are identical to those of the first embodiment. Therefore, any repetitive detail description will be omitted. In the display apparatus according to the fourth embodiment, the judging unit 111 dynamically controls the reflection time based on a result of judgment of a display mode of the display apparatus set by a user.

Shifting the reflection time of an image correction and a change of the brightness of the backlight can suppress a flash phenomenon. However, in a use case where a change of a signal is to be recognized as fast as possible, an image signal may sometimes be visualized with a delay of one frame period. In this case, the reflection time does not need to be shifted. According to the fourth embodiment, a user may determine the reflection time based on a set display mode. Display modes settable by a user here may include, for example, a low delay mode such as a game mode (in which the time period from input of a signal to display thereof is reduced as much as possible) and a cinema mode (in which high priority is given to high quality while low priority is given to delays).

The judging unit 111 is configured to acquire a display mode (game mode (low delay mode), standard, or cinema mode) set by a user through the I/F unit 130. In this case, the I/F unit 130 may set quality of an image to be displayed on the display apparatus. The judging unit 111 judges the display mode and defines zero frame period as a value for the reflection time if the set display mode is the game mode. On the other hand, if the judging unit 111 judges that the set display mode is the cinema mode, one frame period is set for the reflection time to give priority to image quality. If the judging unit 111 judges that the set display mode is the standard mode, the control according to the second embodiment or the third embodiment is executed. Light emission control may be executed with a delay of one or more frame periods if a display mode excluding the low delay modes is set.

In this manner, a set value for the reflection time may be forcibly determined based on the image quality mode set by a user to perform processing for acquiring display that fits to a user's purpose.

Other Embodiments

Embodiment(s) of the present disclosure can also be realized by a computerized configuration(s) of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computerized configuration(s) of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computerized configuration(s) may comprise one or more processors, one or more memories (e.g., central processing unit (CPU), micro processing unit (MPU)), and may include a network of separate computers or separate processors to read out and execute the computer executable instructions. The computer executable instructions may be provided to the computerized configuration(s), for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-103860 filed May 25, 2017, which is hereby incorporated by reference herein in its entirety.

What is claimed is:

1. A display apparatus sequentially receiving frames including a first frame and a second frame and displaying images based on the frames, the apparatus comprising:

a backlight configured to emit light;

a liquid crystal panel configured to display an image by transmitting light from the backlight; and at least one processor configured to perform operations as the following:

setting one operating mode among operating modes;

determining brightness of the backlight based on a frame;

controlling light emission of the backlight with the brightness; and controlling transmittance of the liquid crystal panel based on a frame corrected based on the brightness of the backlight, wherein a first timing when controlling the light emission of the backlight with first brightness based on the first frame is started is later than a second timing when controlling the transmittance of the liquid crystal panel based on the second frame corrected based on the first brightness is started, wherein in a case where a first operation mode is set by the setting, a difference between the first timing and the second timing is longer than in a case where a second operation mode is set by the setting.

2. The display apparatus according to claim 1, wherein the difference between the first timing and the second timing is a period corresponding to a response speed of the transmittance of liquid crystal pixels of the liquid crystal panel.

3. The display apparatus according to claim 1, wherein the second frame is a frame input immediately after the first frame.

4. The display apparatus according to claim 1, wherein in the controlling the transmittance of the liquid crystal panel, controlling the transmittance of the liquid crystal panel is started in synchronization with periodically input vertical synchronization signals.

5. The display apparatus according to claim 1, wherein the at least one processor performs further operations comprising:

judging whether a scene change has occurred between the first frame and the second frame or not, wherein, in a case where it is judged that a scene change has occurred in the judging, the difference between the first timing and the second timing is a first period, and wherein, in a case where it is judged that a scene change has not occurred in the judging, the difference between the first timing and the second timing is a second period, where the second period is shorter than the first period.

6. The display apparatus according to claim 5, wherein in a case where an average value of pixel values of the first frame is equal to or lower than a dark part threshold value and where a difference between an average value of pixel values of the second frame and an average value of pixel values of the first frame is higher than a difference threshold value, it is judged that a scene change has occurred in the judging.

7. The display apparatus according to claim 6, wherein the at least one processor performs further operations comprising:

setting an upper limit of a display brightness of the display apparatus according to a user instruction, and wherein a first dark part threshold value in a case where the upper limit of the display brightness is a first brightness is higher than a second dark part threshold value in a case where the upper limit of the display brightness is a second brightness lower than the first brightness.

8. The display apparatus according to claim 7, wherein a first difference threshold value in a case where the upper limit of the display brightness is the first brightness is lower than a second difference threshold value in a case where the upper limit of the display brightness is the second brightness.

9. The display apparatus according to claim 1, wherein, in a case of displaying OSD (ON screen display), the difference between the first timing and the second timing is longer than one frame period.

10. A control method for a display apparatus having a backlight and a liquid crystal panel, sequentially receiving frames including a first frame and a second frame, and displaying images based on the frames, the method comprising:

setting one operating mode among operating modes;

determining brightness of the backlight based on a frame;

controlling light emission of the backlight with the brightness; and controlling transmittance of the liquid crystal panel based on a frame corrected based on the brightness of the backlight, wherein a first timing when controlling the light emission of the backlight with first brightness based on the first frame is started is later than a second timing when controlling the transmittance of the liquid crystal panel based on the second frame corrected based on the first brightness is started, wherein in a case where a first operation mode is set by the setting, a difference between the first timing and the second timing is longer than in a case where a second operation mode is set by the setting.

* * * * *